United States Patent [19]

Tamada

[11] 4,217,805

[45] Aug. 19, 1980

[54] APPARATUS AND METHOD FOR WRITING RHYTHM INFORMATION IN STORAGE

[75] Inventor: Yukio Tamada, Amagasaki, Japan

[73] Assignee: Roland Corporation, Osaka, Japan

[21] Appl. No.: 973,571

[22] Filed: Dec. 27, 1978

[30] Foreign Application Priority Data

Oct. 3, 1978 [JP] Japan ..... 53-122225

[51] Int. Cl.[3] ..... G10F 1/00

[52] U.S. Cl. ..... 84/1.03; 84/DIG. 12

[58] Field of Search ..... 84/1.03, 1.28, DIG. 12, 84/1.24

[56] References Cited

U.S. PATENT DOCUMENTS

| | | | |
|---|---|---|---|
| 3,637,914 | 1/1972 | Hiyama | 84/1.03 |
| 4,058,043 | 11/1977 | Shibahara | 84/1.03 |
| 4,147,083 | 4/1979 | Woron et al. | 84/1.03 X |

*Primary Examiner*—J. V. Truhe
*Assistant Examiner*—Forester W. Isen
*Attorney, Agent, or Firm*—W. G. Fasse; D. F. Gould

[57] ABSTRACT

A reference rhythm storing read only memory having a plurality of addresses for storing in advance, in an address sequence, information concerning a reference rhythm pattern and a writable/readable rhythm storing random access memory having addresses corresponding to the addresses of the reference rhythm storing memory for allowing for writing/reading information concerning a desired rhythm pattern unit are provided. A sound indication of the reference rhythm pattern is generated by way of a repetition of the reference rhythm pattern unit responsive to the information concerning the reference rhythm pattern read from the reference rhythm storing memory and information concerning a desired rhythm pattern is written into the writable/readable rhythm storing memory through a writing operation by an operator while the above described sound of the reference rhythm pattern is referred to by the operator so that the information concerning a desired rhythm pattern is read out in a synchronized relation with the reference rhythm pattern.

6 Claims, 9 Drawing Figures

| FIG. 4A | FIG. 4B |
|---|---|

APPARATUS AND METHOD FOR WRITING RHYTHM INFORMATION IN STORAGE

BACKGROUND OF THE INVENTION

1. Field of the Invention

The present invention relates to an apparatus and method for writing information concerning a rhythm pattern unit in a storage for generation of a rhythm by way of a repetition of the rhythm pattern unit by an electronic musical instrument. More specifically, the present invention relates to an apparatus and method for writing information concerning a desired kind of rhythm pattern unit, with reference to an indication of a basic rhythm pattern provided based on preloaded information, for generation of a desired kind of rhythm by way of a repetition of the rhythm pattern unit by an electronic musical instrument.

2. Description of the Prior Art

An automatic accompaniment generation of a rhythm for adaptation to a music being performed responsive to rhythm pattern information selected from several kinds of rhythm pattern information stored in a storage has been proposed, such as in an electronic musical instrument, for the purpose of allowing for simultaneous performance of a music by a performer with the generated rhythm. To that end, a read only memory has been used as such storage only for the purpose of reading rhythm pattern information therefrom.

However, in order to generate a sound of a desired kind of rhythm pattern selectively responsive to rhythm pattern information of the desired kind among various kinds of rhythm patterns preloaded in such memory, it is necessary to provide different memories in order to store information concerning various kinds of rhythm patterns in such memories, which increases the cost of the memories and thus the cost of an automatic rhythm generating apparatus.

On the other hand, there has been a desire by music performers that such a unique rhythm pattern that has not been stored in advance in such memory can be stored as desired by themselves in such memory based on their own composition or arrangement so that any of their favorite rhythm patterns can be generated apart from generation of rhythm patterns responsive to preloaded information concerning various rhythm patterns. The present invention achieves that purpose.

SUMMARY OF THE INVENTION

Briefly described, the present invention comprises a reference rhythm storing memory having a plurality of addresses for storing in advance, in an address sequence, information concerning a reference rhythm pattern, and a writable/readable rhythm storing memory having addresses corresponding to the addresses of the reference rhythm storing memory for allowing for writing/reading information concerning a desired rhythm pattern unit. In writing information concerning a desired rhythm pattern unit in the writable/readable rhythm storing memory, an indication such as a sound of the reference rhythm pattern is generated by way of a repetition of the reference rhythm pattern unit responsive to the information concerning the reference rhythm pattern read from the reference rhythm storing memory and information concerning a desired rhythm pattern is entered into the writable/readable rhythm storing memory through a writing operation by an operator while the above described indication such as a sound of the reference rhythm pattern is referred to or listened to by the operator so that the information concerning a desired rhythm pattern is entered in a synchronized relation with the reference rhythm pattern. Preferably, a plurality of writable/readable rhythm storing memories are provided, each corresponding to a different kind of musical instrument for generating a sound responsive to the rhythm pattern information of the corresponding memory, so that synchronized generation of a sound of the reference rhythm pattern responsive to the information in the reference rhythm storing memory and/or a sound of the desired rhythm pattern responsive to information in the writable/readable rhythm storing memories can provide a mixed musical sound corresponding to different musical instruments.

Therefore, a principal object of the present invention is to provide an apparatus and method for writing information concerning a rhythm pattern in a storage in an electronic musical instrument, wherein information concerning a desired rhythm pattern can be entered in a storage with reference to an indication of a reference rhythm pattern the information of which has been preloaded.

Another object of the present invention is to provide an apparatus and method for writing information concerning a rhythm pattern in an electronic musical instrument, wherein information concerning a desired rhythm pattern is written in a writable/readable memory in a rewritable manner by an operator.

A further object of the present invention is to provide an apparatus and method for writing information concerning a rhythm pattern in a storage in an electronic musical instrument, wherein information of an increased number of kinds of rhythm patterns can be selectively loaded with a decreased cost.

Still a further object of the present invention is to provide an apparatus and method for writing information concerning a rhythm pattern in a storage in an electronic musical instrument, wherein one writing operation ensures that information concerning one note being generated is written in a storage irrespective of the length of the writing operation.

These objects and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
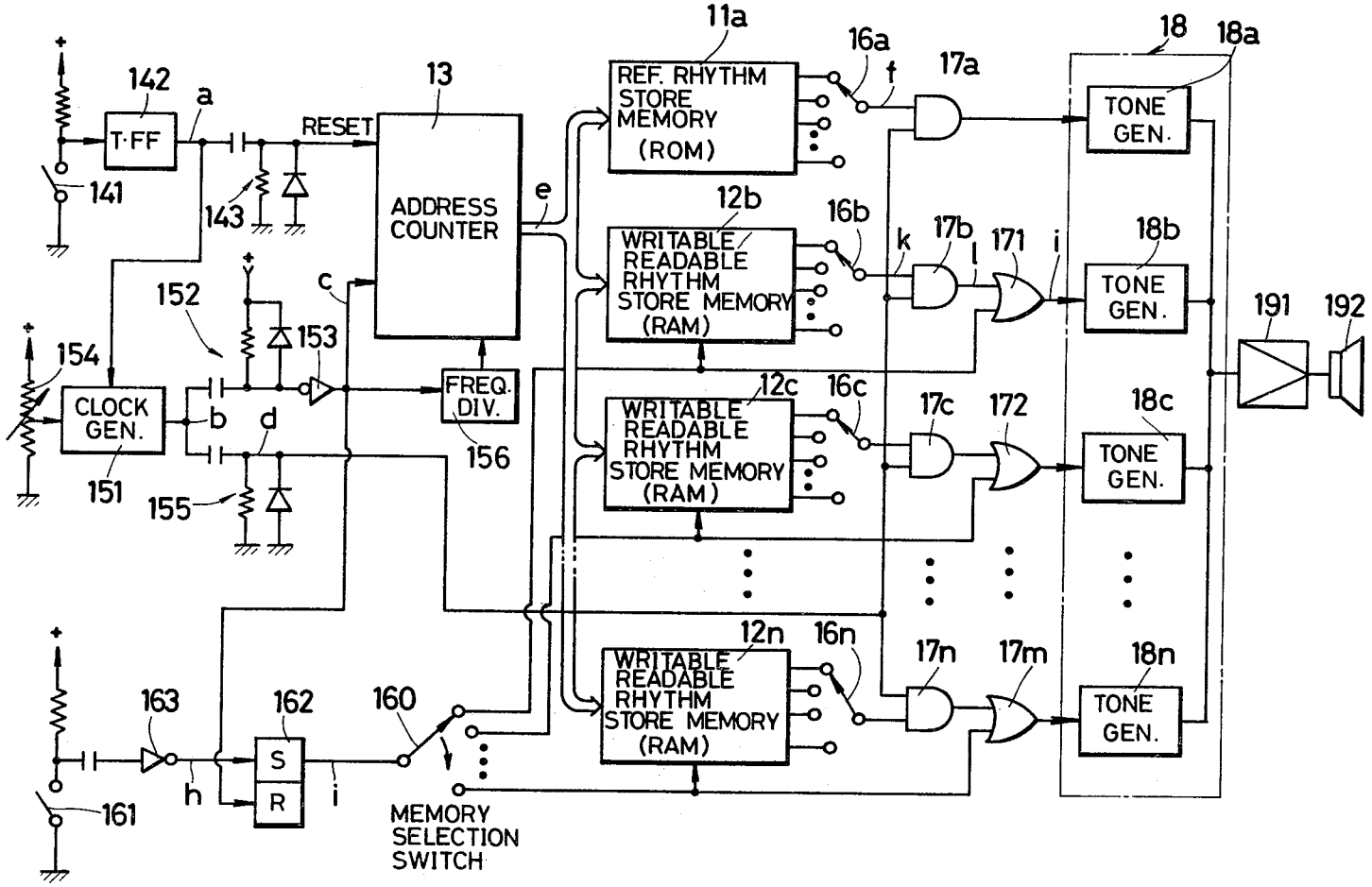
FIG. 1 shows a block diagram of one embodiment of the inventive rhythm pattern writing apparatus.

FIG. 1 shows a block diagram of one embodiment of the inventive rhythm pattern writing apparatus. The embodiment shown comprises a reference rhythm pattern storing memory 11*a* having a plurality of addresses for storing in advance in an address sequence the information concerning a reference rhythm pattern unit, and a writable/readable rhythm pattern storing memory 12*b* having a plurality of addresses corresponding to the addresses of the reference rhythm pattern storing memory 11*a* for allowing for selective writing and reading of the information concerning a desired rhythm pattern unit. The reference rhythm pattern storing memory may comprise a read only memory, while the writable/-readable rhythm pattern storing memory 12*b* may comprise a random access memory. Preferably the writable/readable rhythm pattern storing memory comprises a plurality of random access memories 12*b* to 12*n* allotted to a plurality of kinds of musical instruments for generating different sound signals corresponding to the respective musical instruments. An address counter 13 is provided coupled to the read only memory 11*a* and the random access memories 12*b* to 12*n* for commonly addressing the addresses of the memories. The address counter 13 is connected to receive, as an initial reset signal, a rise differentiated output of a differentiation circuit 143 obtainable responsive to the output of a flip-flop 142 of a toggle type or a T type, the storing state of which is reversed upon depression of a start stop command switch 141. The address counter 13 is further supplied with, as a step command signal, an inverted output of an inverter 153, which is connected to invert a fall differentiated output of a fall differentiation circuit 152 connected to differentiate the fall of the output pulse of a clock generator 151 which is adapted to generate a reference clock signal. The above described inverted output of the fall differentiated output of the clock signals is also applied to a frequency divider 156 so that the inverted output is frequency divided by the frequency division rate corresponding to the number of addresses, say 48, of the memories for the purpose of repetitively reading out the rhythm pattern unit information stored in the read only memory 11*a* and the random access memories 12*b* to 12*n*. The output of the frequency divider 156 is applied to the address counter 13 as a signal for commanding a return to a head address, or a repetition command signal. The embodiment further comprises a memory selection switch 160 for selecting any of the random access memories where the information concerning a desired rhythm pattern unit is written in a synchronized relation with the reference rhythm pattern, a write command switch 161 for commanding a writing operation in response to depression thereof, a flip-flop 162 adapted to be reset responsive to each reference clock signal and to store a writing state in response to depression of the write command switch 161, an inverter 163, and switches 16*a* to 16*n* for switching in a ganged fashion the read outputs of the read only memory 11*a* and the random access memories 12*b* to 12*n* in a bit parallel fashion. AND gates 17*a* to 17*n* are provided associated with the read only memory 11*a* and the random access memories 12*b* to 12*n*, respectively, for reading the data in the respective bit positions of the addresses being addressed in synchronism with the reference clock signals, so that the outputs of the respective AND gates 17*a* to 17*n* are applied directly or through OR gates 171 to 17*m* to tone generators 18*a* to 18*n* of a sound signal circuit 18. The tone generators 18*a* to 18*n* are adapted to be responsive to the input pulses to generate the respective tone signals of the corresponding sounds of the corresponding kinds of the musical instruments allotted to the respective memories. The outputs of the respective tone generators are mixed and the mixed output is amplified by an amplifier 191 and is applied to a speaker 192, where the mixed output is transduced to a sound.

Figure 2A:
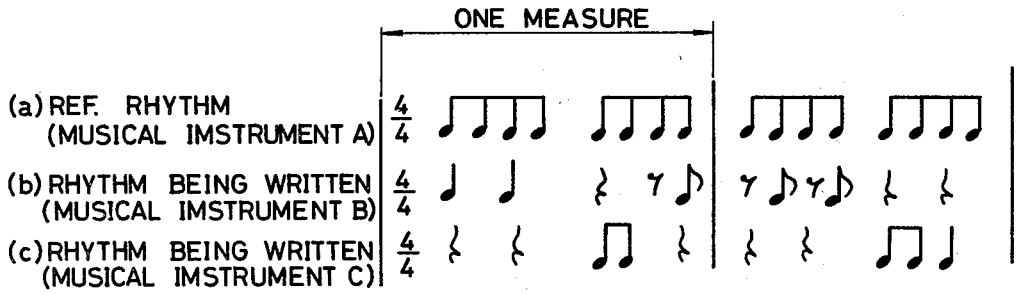
FIGS. 2A and 2B each are an illustration showing the musical characters of a reference rhythm pattern and the musical characters of a rhythm pattern being desirably stored for each of different kinds of rhythm patterns.

FIG. 2A is an illustration showing the musical characters of a samba rhythm by way of an example of a desired rhythm pattern unit which is to be written in a random access memory in accordance with the present invention, wherein the illustration (a) shows the musical characters of the reference rhythm pattern unit stored in advance in the read only memory 11*a*, the illustration (b) shows the musical characters of a desired rhythm pattern unit that an operator desires to write in the random access memory 12*b*, and the illustration (c) shows the musical characters of a desired rhythm pattern unit that an operator desires to write in the random access memory 12*c*. The read only memory 11*a* is adapted to store a rhythm pattern unit which is to be generated by a given kind of musical instrument, say the musical instrument A, the random access memory 12*b* is adapted to store a rhythm pattern unit which is to be generated by another kind of musical instrument, say the musical instrument B, and the random access memory 12*c* is adapted to store a rhythm pattern unit of a further kind of musical instrument, say the musical instrument C.

Figure 2B:
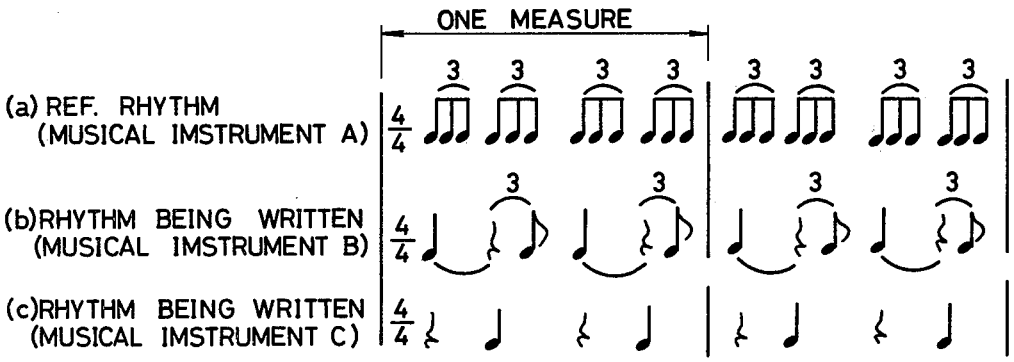

FIG. 2B is an illustration showing the musical characters of a slow rock rhythm by way of another example of a desired rhythm pattern unit being generated in accordance with the present invention, wherein the illustration (a) shows the musical characters of a reference rhythm pattern unit for the musical instrument A which is to be stored in advance in the read only memory 11*a*, the illustration (b) shows the musical characters of a desired rhythm pattern unit for the musical instrument B which is to be stored in the random access memory 12*b*, and the illustration (c) shows the musical characters of a desired rhythm pattern unit for the musical instrument C which is to be stored in the random access memory 12*c*.

Table 1 shows the logical states of the information concerning a reference rhythm pattern unit being stored in advance in the read only memory 11*a*, wherein the abscissa indicates the kind of rhythm pattern and the ordinate indicates the address number. Referring to Table 1, the logical states of the information concerning the samba rhythm are shown in the first bit position of the respective addresses by way of an example of the reference rhythm pattern unit. More specifically, the logic one in the Table represents a note being generated, while the logic zero in the Table represents a note being not generated. In order to store the rhythm pattern units of various kinds of the rhythms in the above described read memory 11*a*, a scheme is employed to generate a minimum note element common to the various kinds of the rhythm pattern units, for example one note of a group of three notes of a three-divided eighth note, by allotting the number of sixth addresses to a quarter note, so that a samba rhythm in two measures is stored in forty-eight addresses Nos. 0 to 47 for a four-quarter measure, for example. Therefore, in case where a group of eighth notes continuing for two measures is stored, the reference rhythm pattern unit shown in FIG. 2A is stored such that the logic one is loaded at the head address, i.e. the address No. 0 and every third address while the logic zero is loaded in the remaining addresses, whereby the reference rhythm pattern of the samba rhythm being generated by the musical instrument A is stored.

The logical states of the information concerning the reference rhythm pattern unit of the slow rock rhythm shown in FIG. 2B as stored in the read only memory 11*a* are shown in the second bit position of the respective addresses in Table 1. More specifically, the logic one is loaded in the head address, i.e. the address No. 0 and the logics zero and one are alternately loaded in further addresses, whereby the reference rhythm pattern unit of the slow rock rhythm being generated by the musical instrument A is loaded as a group of three notes of a three-divided fourth note.

Table 2 shows the logical states of the information concerning various kinds of rhythm pattern units being generated by the musical instrument B stored in accordance with the present invention, wherein the logical state pattern in the first bit position of the respective addresses represents, in an address sequence, a samba rhythm, the logical state pattern in the second bit position of the respective addresses represents, in an address sequence, a slow rock rhythm, and so on. Similarly, Table 3 shows the logical states of the information concerning various kinds of rhythm pattern units being generated by the musical instrument C stored in accordance with the present invention, wherein the logical state pattern at the first bit position of the respective addresses represents, in an address sequence, a samba rhythm, the logical state pattern at the second bit position of the respective addresses represents, in an address sequence, a slow rock rhythm, and so on.

Figure 3:
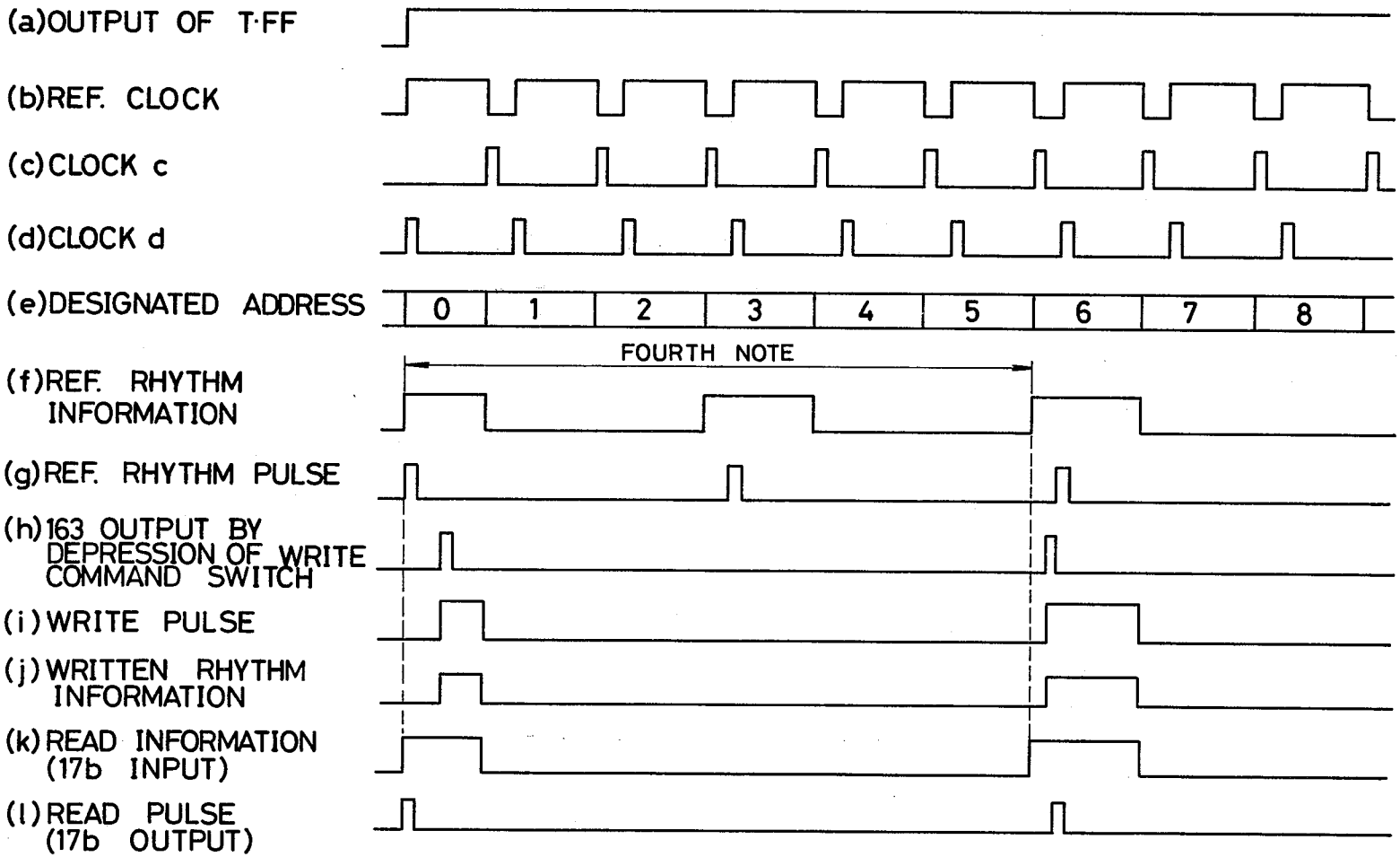
FIG. 3 shows waveforms of electrical signals at various portions in the FIG. 1 diagram.

FIG. 3 shows waveforms of electrical signals at various portions in the FIG. 1 embodiment for explanation of an operation of the FIG. 1 embodiment, particularly for explanation of an operation of the FIG. 1 embodiment when the information concerning a rhythm pattern unit for the musical instrument A is written in the memory with reference to a sound indication of the reference rhythm pattern of the musical instrument A shown in FIG. 2A.

Referring now to FIGS. 1, 2A and 3 and Tables 1 and 2, an operation of the embodiment when the information concerning a rhythm pattern unit for the musical instrument B is written in the random access memory 12*b* will be described in the following. An operator first operates the memory selection switch 160 to select the random access memory 12*b* and then depresses the start stop command switch 141. The operator further turns the switches 16*a* to 16*n* to a desired kind of reference rhythm pattern, say samba, so that the bit position of the read only memory 11*a* and the random access memories 12*b* to 12*n*, say to the first bit position. Assuming that the random access memories 12*b* to 12*n* each comprise a onebit memory, then the switches 16*b* to 16*n* can be dispensed with. The storing state of the toggle type flip-flop 142 is reversed responsive to depression of the start stop command switch 141, so that the toggle type flip-flop 142 provides the high level output a, as shown in FIG. 3(*a*). The rise of the high level output signal a is differentiated by the rise differentiation circuit 143 and the rise differentiated output is applied to the address counter 13 to initially reset the same, i.e. the count value in the address counter 13 corresponding to the address number of the memories is reset. The high level output signal a of the toggle type flip-flop 142 is also applied to the clock generator 151 to enable the same. As a result, the clock generator 151 generates during the period of the above described high level output signal a a reference clock signal b, as shown in FIG. 3(*b*), the frequency of which is selected through adjustment of a tempo adjusting variable resistor 154. The rise of the reference clock signal b is differentiated by the rise differentiation circuit 155 to provide a first reference clock signal, referred to as a clock d hereinafter, which is applied to the AND gates 17*a* to 17*n* as one input of each of the gates. Since the count value or the address number in the address counter 13 is zero at that time, the address counter 13 serves to select the address No. 0 of the read only memory 11*a* and the random access memories 12*b* to 12*n*, as shown in FIG. 3(*e*). Accordingly, the logic one stored in the first bit position of the address No. 0 of the read only memory 11*a* is read out by way of the reference rhythm information f and the read output is applied to the other input of the AND gate 17*a*. Therefore, the AND gates 17*a* provides a reference rhythm pulse g, as shown in FIG. 3(*g*), which is applied to the tone generator 18*a* as a tone generate enabling signal, so that a sound signal of the musical instrument A is generated. The sound signal of the musical instrument A thus obtained by the tone generator 18*a* is amplified by the amplifier 171 and is transduced to a sound of the musical instrument A by the speaker 192. At the same time, the operator or a performer depresses the write command switch 161 in order to write the information concerning a rhythm pattern of the musical instrument B by way of a quarter note. The output signal of the write command switch 161 is inverted by the inverter 163 to provide a signal h, as shown in FIG. 3(*h*), which is applied to the flip-flop 162 to set the same. The set output i of the flip-flop 162 is applied through the memory selection switch 160 to the random access memory 12*b* as a write enable signal. Therefore, the logic one is written in the first bit position of the address No. 0 as addressed by the address counter 13. The set output of the flip-flop 162 is also applied through the memory selection switch 160 and the OR gate 171 to the tone generator 18*b* as a tone generate enabling signal j, whereby a sound signal of the musical instrument B is generated. The sound signal thus generated by the tone generator 18*b* is amplified by the amplifier 191 and is transduced to a sound of the musical instrument B by the speaker 192.

If and when the reference clock signal b obtained from the clock generator 151 turns to the low level, the fall of the reference clock signal B is differentiated by the fall differentiation circuit 152, thereby to provide a fall differentiated output. The fall differentiated output is inverted by the inverter 153 to provide a second reference clock signal c, referred to as a clock c hereinafter, as shown in FIG. 3(*c*). The clock c is applied to the address counter 13 to step the count value and is also applied to the frequency divider 156. The address counter 13 is responsive to the initial clock c to step the count value by one, so that the count value becomes one, which is applied to the read only memory 11*a* and the random access memories 12*b* to 12*n* as addressing information, whereby the address No. 1 is selected in these memories. At the same time, the clock c is applied to the flip-flop 162 to reset the same, thereby to ensure that any further depression of the write command switch 161 even after the writing period for the address No. 0 is invalidated and thus the write signal i is limited in the period for designating the address No. 0. As a result, any erroneous writing operation that might be caused by continual depression of the write command switch 161 prolonged to the period for designating the following address is effectively prevented.

Similarly, each time the reference clock signal b is obtained, the address counter 13 is stepped one by one responsive to the fall of the reference clock signal to increase the count value, whereby the address being addressed of the respective memories is in succession stepped. When the address counter 13 comes to address the address No. 3, the logic one stored in the address No. 3 of the read only memory 11*a* is read out and is applied through the AND gate 17*a* to the tone generator 18*a* when the clock d obtained by the rise differentiation of the reference clock signal is applied to the AND gate 17*a*. As a result, a reference rhythm sound is again produced.

Each time the reference clock signal d turns to the low level, the address counter 13 is stepped in succession to increase the count value. If and when the count value in the address counter 13 comes to designate the address No. 6 of the memories, a reference rhythm pulse is obtained in the same manner as described in the foregoing. Then the operator may depress the write command switch 161 to write the information concerning a quarter note corresponding to a rhythm sound of the musical instrument B. As a result, the flip-flop 162 is set and the write pulse i is written in the address No. 6 of the random access memory 12*b*. Thus, information of a desired rhythm pattern of the musical instrument B is written in the random access memory 12*b* with reference to a sound indication of the reference rhythm pattern produced by the speaker 192. While the reference rhythm of samba in two measures is read out and the corresponding sound is produced, information concerning a rhythm pattern unit of the musical instrument B is written in the first bit position of the respective addresses of the random access memory 12*b*. The logical states of the information concerning the samba rhythm pattern unit of the musical instrument B thus written in the random access memory 12*b* are shown in an address sequence in the first bit position of the respective addresses in Table 2.

In order to write the information concerning a rhythm pattern unit of samba for the musical instrument C, as shown by the musical characters in FIG. 2A(c), the memory selection switch 160 is first operated to select the random access memory 12*c* and then substantially the same operation as described in the foregoing is effected, whereby the logical states as shown in the first bit position in Table 3 are stored in an address sequence.

For the purpose of reading the information of a desired rhythm pattern of different kinds of musical instruments thus stored in the random access memories 12*b* and 12*c* as well as the information concerning the reference rhythm pattern unit as in advance stored in the read only memory 11*a* to produce a mixed sound of various rhythm patterns of various kinds of musical instruments, the write command switch 161 is opened and the start stop command switch 141 is depressed. Then the address counter 13 is controlled to designate the head address of the memories, whereupon the address is stepped one by one responsive to generation of each clock signal and the addresses of the read only memory 11*a* and the random access memories 12*b* and 12*c* are in succession addressed. As a result, the logical states stored in the addresses being addressed in the respective memories are read out responsive to the rise differentiated clock d obtained by differentiation of the reference clock signal b. The output signals thus obtained are shown by the waveforms k and l in FIG. 3.

On the other hand, in case where the information concerning a rhythm pattern unit of the musical instruments B and C with reference to a slow rock reference rhythm pattern shown in FIG. 2B, the logic one is written in the addresses corresponding to a timing where a rhythm sound is to be generated among the addresses of the random access memories 12*b* and 12*c* with reference to or in a synchronized relation with a sound indication of the reference rhythm obtained based on the output signal read from the read only memory 11*a* in substantially the same manner as done in writing a samba rhythm pattern unit as described previously. The logical states of the information thus written in the second bit position of the respective addresses of the memories are shown in Tables 2 and 3.

As seen from the foregoing description, even if there is a slight difference between the timing point of depression of the write command switch 161 and the timing of the reference rhythm read pulse g in the write operation, the read output of the information concerning the rhythm pattern unit as stored, such as k, is read at the timing of the clock pulse d, i.e. at the same timing as the reference rhythm pulse g by way of the read pulse l and is applied through the OR gate 171 to the tone generator 18*b*. Therefore, the rhythm sound as stored in the memories is reproduced at the timing in synchronism with that of the reference rhythm sound. Accordingly, the write command switch 161 can be properly depressed at any timing within the time period of the clock pulse c, with the result that the writing operation of a desired rhythm pattern can be effected with ease so as to be in synchronism with the reference rhythm pattern.

The FIG. 1 embodiment was described in the foregoing as employing the flip-flop 162 for the purpose of ensuring that one writing operation in one address is effected responsive to one depression of the write command switch 161 even if depression of the write command switch is prolonged to the duration for designating the following address. Alternatively, however, the depression output signal of the write command switch 161 may be differentiated and the differentiated pulse output may be directly utilized as a write command pulse to the same end, so that even if the write command switch 161 is kept depressed to cover even the time period for addressing the following address only one address at the time of the beginning of depression is subjected to the writing operation.

Figures 4, 4A:
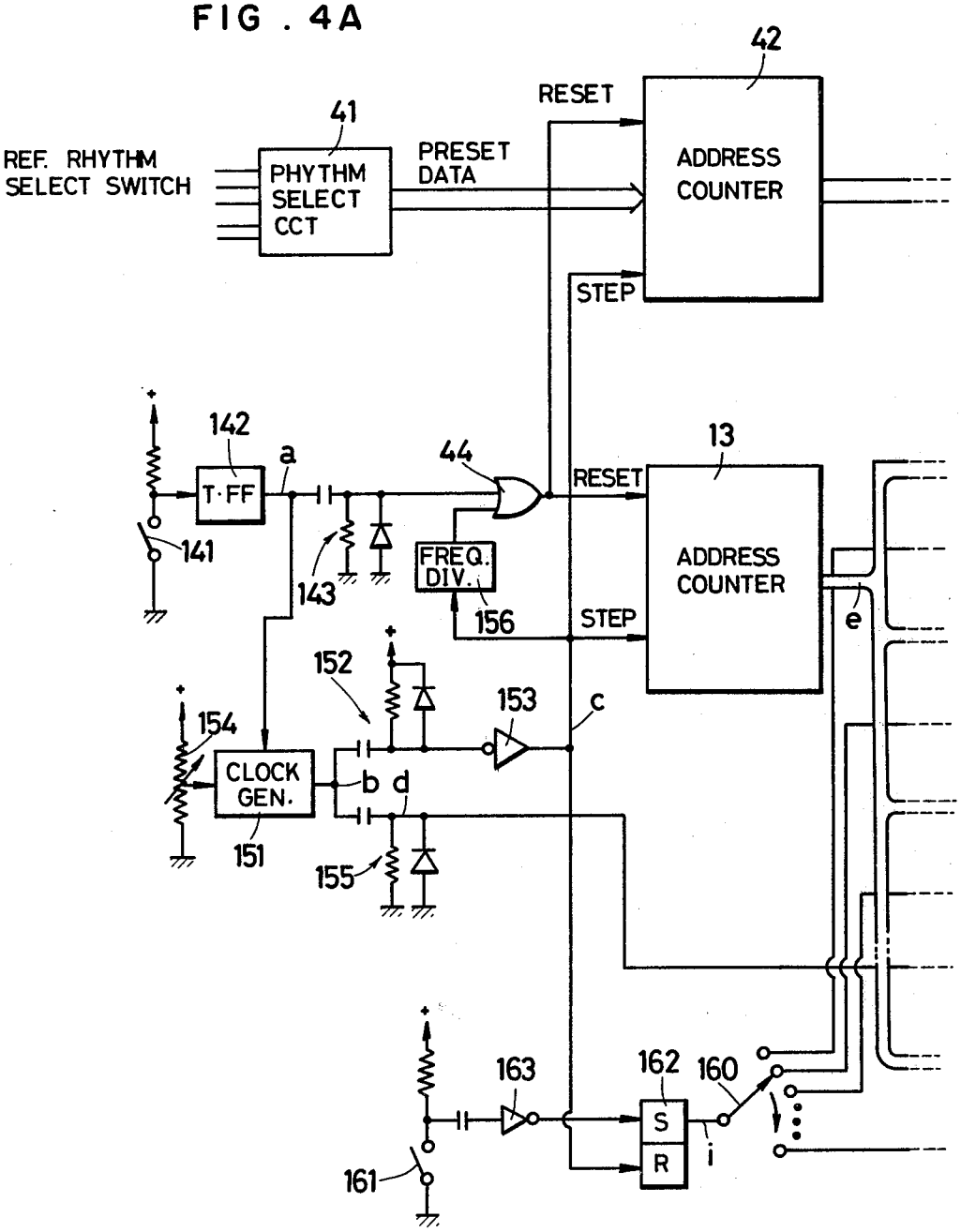
FIGS. 4A and 4B show a block diagram of another embodiment of the present invention.
Figure 4B:
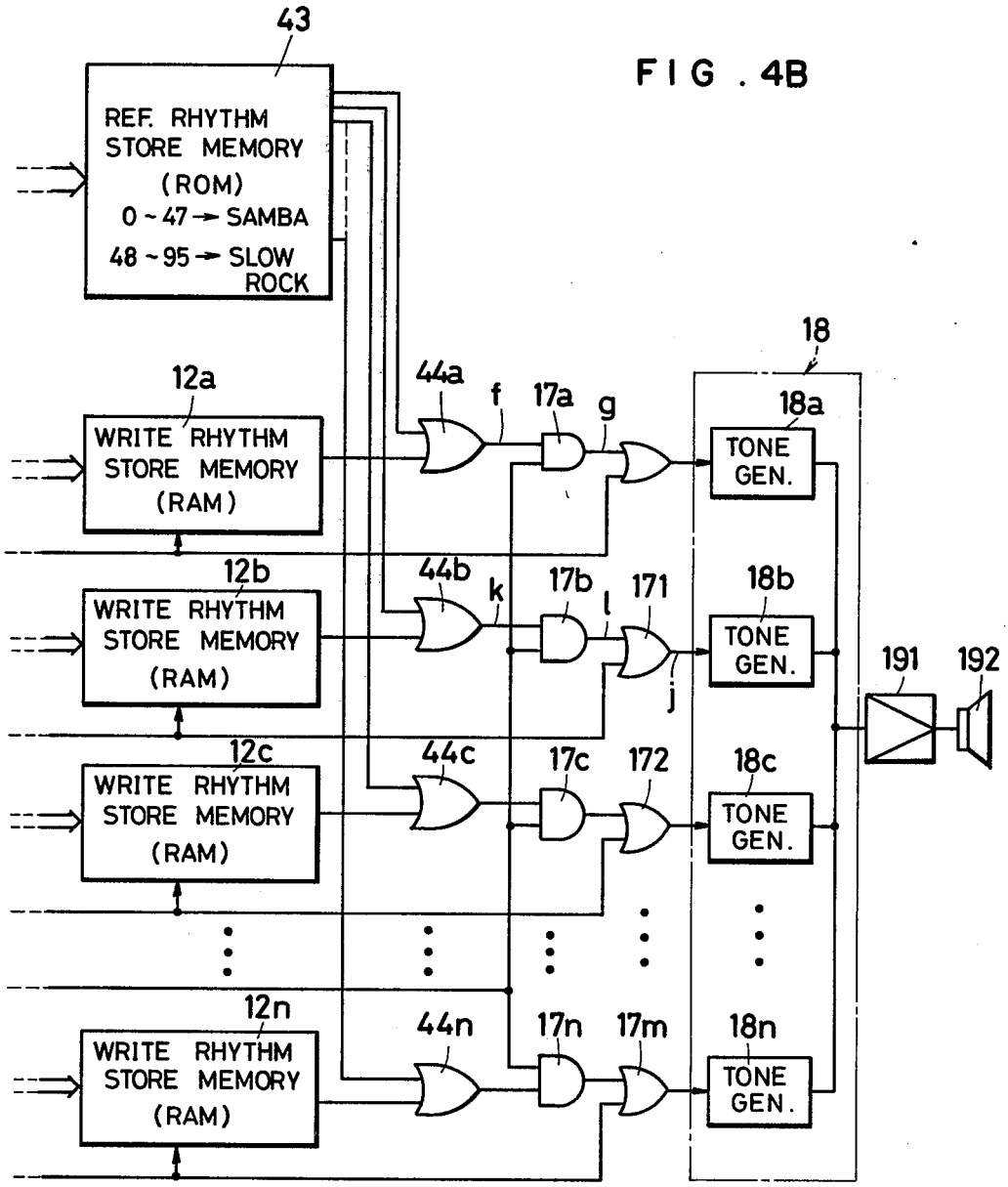

FIG. 4 shows a block diagram of another embodiment of the present invention. One feature of the embodiment shown is that a plurality of writable/readable rhythm storing memories 12*a* to 12*n* implemented by random access memories and a reference rhythm storing memory 43 implemented by a read only memory comprise random access memories and a read only memory each having a plurality of regions, each storing region having a predetermined number of addresses, each address having one bit position, wherein the said predetermined number of addresses in each storing region, say forty-eight addresses, are allotted for storing in advance the information concerning one kind of rhythm pattern unit. According to the embodiment shown, when a reference rhythm selection switch, not shown, is operated to select a desired kind of reference rhythm pattern, a rhythm selection circuit 41 serves to initially set the head address of the storing region where the information concerning the selected kind of the reference rhythm pattern is stored in the read only memory 43 into the address counter 43, whereupon the address counter 42 is stepped in synchronism with the stepping operation of the address counter 13 responsive to the clock c. The read output of the information concerning the reference rhythm pattern unit as read out from the read only memory 43 is applied through the OR gates 44*a* to 44*n* provided to correspond to the random access memories 12*a* to 12*n*, respectively. Since the circuit configuration and the operation of the remaining circuit portions in the FIG. 4 embodiment are substantially the same as those in the FIG. 1 embodiment, like portions have been denoted by like reference characters, while a detailed description thereof will be omitted.

In the foregoing, the FIG. 1 embodiment and the FIG. 4 embodiment were described as embodied by a hardware implementation for the purpose of the writing operation of the data concerning a desired kind of rhythm pattern with reference to a sound indication of the reference rhythm produced based on the information stored in advance in a storage. However, it is pointed out that substantially the same operation can be achieved by using a microprocessor adapted to execute such operation.

Figure 5:
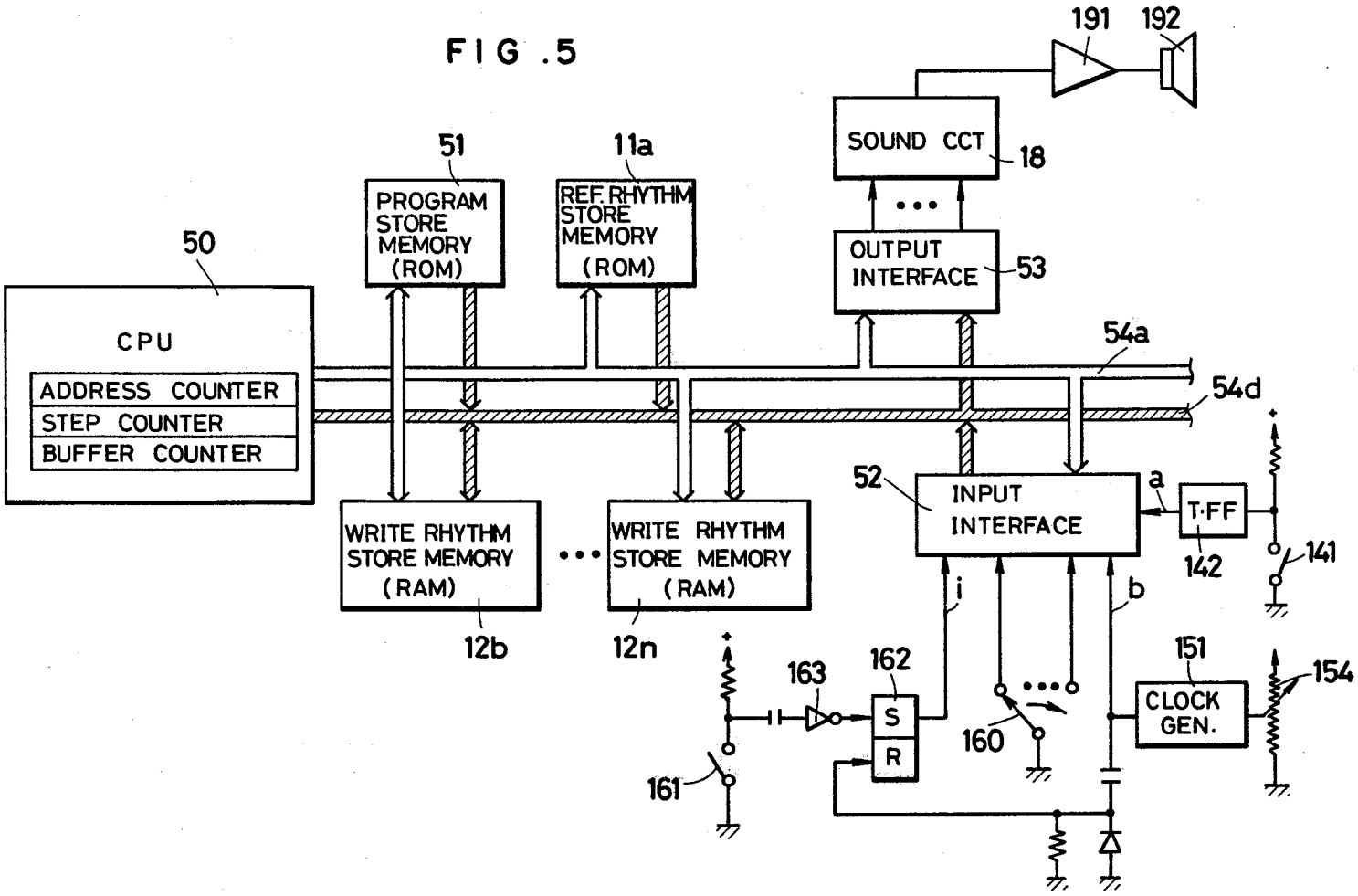
FIG. 5 shows a block diagram of a further embodiment of the present invention for use in writing information concerning a rhythm pattern in accordance with the present invention.
Figure 6:
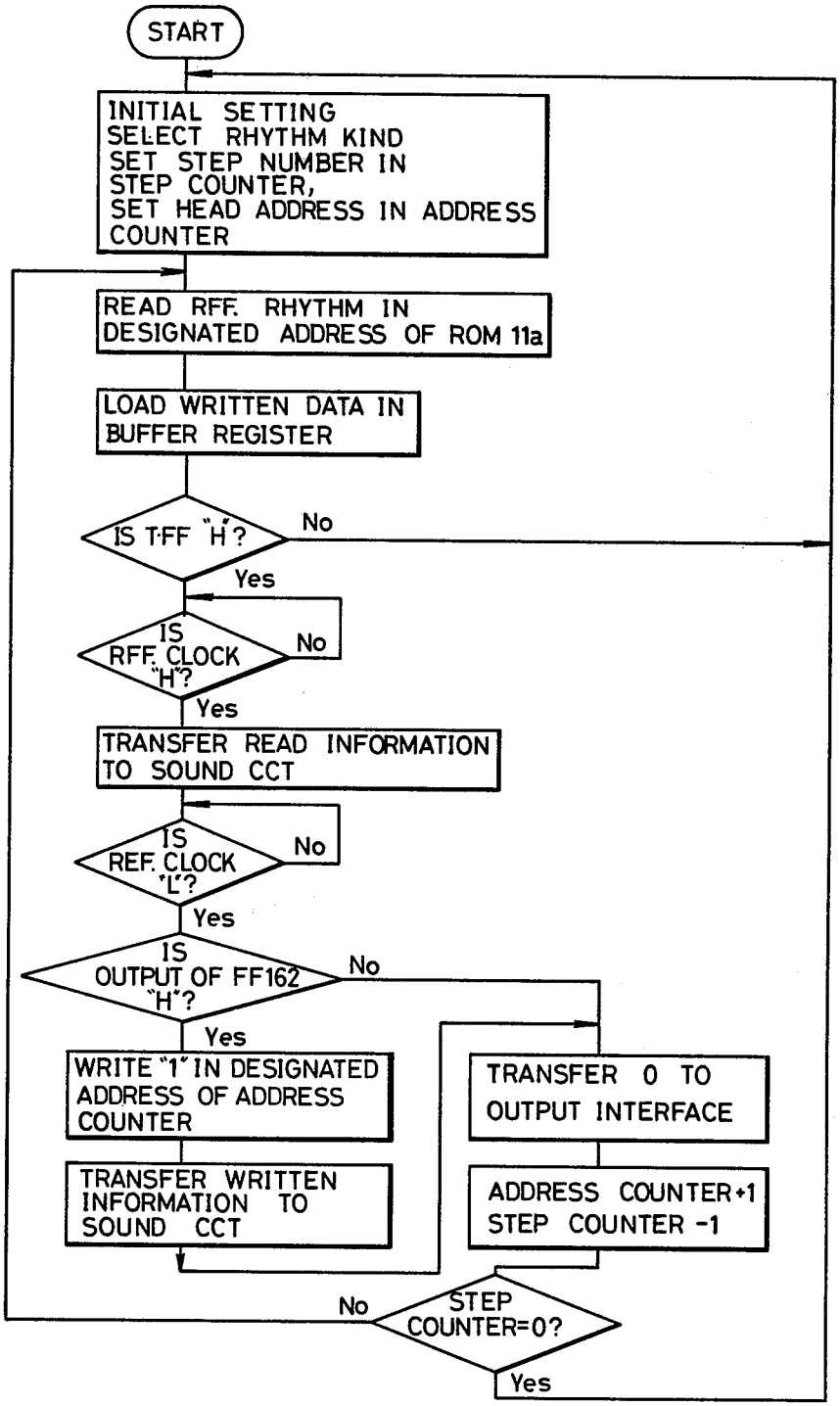
FIG. 6 shows a flow chart for depicting a method for writing information concerning a rhythm pattern in accordance with the present invention.

FIG. 5 shows a block diagram of a further embodiment of the present invention for use in writing the information concerning a rhythm pattern unit in accordance with the present invention, wherein a microprocessor is employed to control the writing operation of information concerning a desired kind of rhythm pattern unit with reference to a sound indication of the reference rhythm pattern produced based on the information stored in advance in a storage in accordance with a software. More specifically, a central processing unit 50 such as a microprocessor comprises a program storing memory 51 implemented by a read only memory, for example, for storing in advance a program as shown in FIG. 6 to be described subsequently, a reference rhythm storing memory 11*a* implemented by a read only memory for storing in advance the information concerning a reference rhythm unit in an address sequence, writable/readable rhythm storing memories 12*b* to 12*n* implemented by random access memories for storing the information concerning a desired kind of rhythm pattern unit in an address sequence, an input interface 52 and an output interface 53, which are operatively coupled to an address bus 54*a* and a data bus 54*d*. The central processing unit 50 further comprises an address register for temporarily storing a selected address, a step register for temporarily storing a step number and a buffer register. The head address of the storing region of the selected kind of rhythm pattern in the read only memory 11*a* and the random access memories 12*b* to 12*n* is preset in the address register and the address number in the address register is stepped for each step of the addressing operation in a renewal manner, so that the address register serves as an address counter. When the head address is preset in the address register, the number of addresses adapted to store the same kind of rhythm, say the address number of 48, is preset in the step register and the step number in the step register is reduced one by one for each step of the addressing operation in a renewal manner, so that the step register serves as a step counter. The input interface 52 is operatively coupled to receive the output of the toggle type flip-flop 142 the output state of which is reversed responsive to depression of the start stop command switch 141, the clock pulse output, i.e. the reference clock signal b of the clock generator 151 the frequency of which is variable by adjustment of the tempo adjusting variable resistor 154, the selection output of the memory selection switch 160, and the write command output signal of the flip-flop 162 adapted to be set responsive to depression of the write command switch 161 and to be reset responsive to the fall differentiated output of the difference clock signal b. The output of the output interface 53 is applied to the sound circuit 18 and the output of the sound circuit 18 is amplified by the amplifier 191 and is transduced to a sound by the speaker 192.

FIG. 6 shows a flow chart for depicting a method for writing the information concerning a rhythm pattern in accordance with the present invention. With simultaneous reference to FIGS. 5 and 6, the writing operation of the information concerning a rhythm pattern unit in accordance with a software will be described in the following. First of all a desired kind of the reference rhythm pattern unit is selected so that the bit position being written and being read of the read only memory 11*a* and the random access memories 12*b* to 12*n* is specified. Then the memory selection switch 160 is selectively switched so that a desired memory, for example the random access memory 12*b*, is selected for writing the information concerning a rhythm pattern. The head address is then preset, for example the address No. 0 is preset, in the address counter in the central processing unit 50. The address number for the reference rhythm pattern unit preloaded in the read only memory 11*a*, i.e. the address number of 48 for storing the rhythm pattern of two measures, is preset in the step counter of the central processing unit 50. Then the information concerning the rhythm pattern unit in the addresses of the read only memory 11*a* as addressed by the address counter, represented by a combination of the logic one representing a note being generated and the logic zero representing a note being not generated, is read out. If some data has been stored in the random access memory 12*b*, then the data is transferred to and stored by the buffer register of the central processing unit 50. If no data has been stored in the random access memory, then the next step follows to determine whether the output of the toggle type flip-flop 142 is the high level. If and when the output of the toggle type flip-flop 142 is the low level signal, which means that the start stop command switch 141 has not been depressed, then the state is stood by, while the above described operation is repeated, and if and when the start stop command switch 141 is depressed in such a situation, the next step follows.

If and when the output of the toggle type flip-flop 142 becomes the high level, then it is determined whether the reference clock signal b obtained from the clock generator 151 is the high level, and the state is stood by until the reference clock signal b becomes the high level. If and when the clock signal becomes the high level, the information stored in the address of the read only memory 11*a* as addressed by the address counter is read out and is applied through the data bus 54*d* and further through the output interface 53 to the sound circuit 18, where the read output is converted into a sound signal and the sound signal thus obtained is amplified by the amplifier 191 and is transduced to a sound by the speaker 192. Then it is determined whether the reference clock signal b is the low level and if and when the reference clock signal b is in the high level period the state is stood by. If and when the reference clock signal b is reversed to the low level in such a situation, then it is determined whether the flip-flop 162 has been set responsive to depression of the write command switch 161, i.e. the said output of the flip-flop 162 is the high level. If the write command switch 161 has been depressed, the logical state of the logic one is loaded or is written in the address of the random access memory **12*b* as addressed by the address counter and at the same time the logical state output is applied to the sound circuit so that the information is outputted by way of a sound indication, whereupon the next step follows. If and when the write command switch 161 has not been depressed, the next step follows, without the logic one being not written in. In the following step, the logic zero is transferred to the output interface and the address counter is stepped by one so that the count value is increased by one and the following address is addressed, while one is subtracted from the count value in the step counter which could value assumes the value of 48 in the initial state, whereupon it is determined in the next step whether the count value in the step counter is zero. Since at that time the count value of the address counter is one and the count value in the step counter 47, the information concerning the reference rhythm pattern stored in the address No. 1 of the read only memory 11*a*** as addressed by the address counter is read out. The above described operation is repeated until the count value in the step counter becomes zero and the address number specified by the address counter becomes the address No. 48, when the writing operation of the information concerning the desired reference rhythm pattern unit of two measures is completed.

When the information concerning another kind of rhythm pattern unit is to be stored in another memory, the initial setting is made again to that end. The operator then turns the memory selection switch 160 to select another random access memory, say the random access memory **12*c* to store the information concerning another kind of rhythm pattern unit for the musical instrument C, inasmuch as the above described rhythm pattern has been stored with reference to the reference rhythm pattern unit of two measures. If and when the writing operation is to be terminated, the operator depresses the start stop command switch 141, whereby the output of the toggle type flip-flop 142 is reversed to the low level, so that the writing operation is terminated. Thus, the information concerning a desired rhythm pattern can be stored in any selected random access memory with reference to a sound indication produced based on the information concerning a reference rhythm pattern preloaded in the read only memory 11*a***.

If and when the information concerning the desired rhythm patterns stored in the random access memories **12*b* and so on and the information concerning the reference rhythm pattern stored in advance in the read only memory 11*a* are to be simultaneously read out, the operator effects the initial setting of various counters and depresses the start stop command switch 141, while the operator does not depress the write command switch 161, so that the operation progresses in accordance with the flow chart as shown in FIG. 6**.

Although the present invention has been described and illustrated in detail, it is to be clearly understood that the same is by way of illustration and example only and is not to be taken by way of limitation, the spirit and scope of the present invention being limited only by the terms of the appended claims.

Table 1

Reference Rhythm Storing Memory (Instrument A)

| Address / Bit | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 |
|---|---|---|---|---|---|---|---|---|---|---|---|---|---|---|---|---|---|---|---|---|---|---|---|---|
| 1 Samba | 1 | 0 | 0 | 1 | 0 | 0 | 1 | 0 | 0 | 1 | 0 | 0 | 1 | 0 | 0 | 1 | 0 | 0 | 1 | 0 | 0 | 1 | 0 | 0 |
| 2 Slow Rock | 1 | 0 | 1 | 0 | 1 | 0 | 1 | 0 | 1 | 0 | 1 | 0 | 1 | 0 | 1 | 0 | 1 | 0 | 1 | 0 | 1 | 0 | 1 | 0 |
| . | | | | | | | | | | | | | | | | | | | | | | | | |
| . | | | | | | | | | | | | | | | | | | | | | | | | |
| . | | | | | | | | | | | | | | | | | | | | | | | | |
| n | | | | | | | | | | | | | | | | | | | | | | | | |

| Address / Bit | 24 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 |
|---|---|---|---|---|---|---|---|---|---|---|---|---|---|---|---|---|---|---|---|---|---|---|---|---|
| 1 Samba | 1 | 0 | 0 | 1 | 0 | 0 | 1 | 0 | 0 | 1 | 0 | 0 | 1 | 0 | 0 | 1 | 0 | 0 | 1 | 0 | 0 | 1 | 0 | 0 |
| 2 Slow Rock | 1 | 0 | 1 | 0 | 1 | 0 | 1 | 0 | 1 | 0 | 1 | 0 | 1 | 0 | 1 | 0 | 1 | 0 | 1 | 0 | 1 | 0 | 1 | 0 |
| . | | | | | | | | | | | | | | | | | | | | | | | | |
| . | | | | | | | | | | | | | | | | | | | | | | | | |
| . | | | | | | | | | | | | | | | | | | | | | | | | |
| n | | | | | | | | | | | | | | | | | | | | | | | | |

Table 2

Writable/Readable Rhythm Storing Memory (Instrument B)

| Address / Bit | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 |
|---|---|---|---|---|---|---|---|---|---|---|---|---|---|---|---|---|---|---|---|---|---|---|---|---|
| 1 Samba | 1 | 0 | 0 | 0 | 0 | 0 | 1 | 0 | 0 | 0 | 0 | 0 | 0 | 0 | 0 | 0 | 0 | 0 | 0 | 0 | 0 | 1 | 0 | 0 |
| 2 Slow Rock | 1 | 0 | 0 | 0 | 0 | 0 | 0 | 0 | 0 | 0 | 1 | 0 | 1 | 0 | 0 | 0 | 0 | 0 | 0 | 0 | 0 | 0 | 1 | 0 |
| . | | | | | | | | | | | | | | | | | | | | | | | | |
| . | | | | | | | | | | | | | | | | | | | | | | | | |
| . | | | | | | | | | | | | | | | | | | | | | | | | |
| n | | | | | | | | | | | | | | | | | | | | | | | | |

| Address / Bit | 24 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 |
|---|---|---|---|---|---|---|---|---|---|---|---|---|---|---|---|---|---|---|---|---|---|---|---|---|
| 1 Samba | 0 | 0 | 0 | 1 | 0 | 0 | 0 | 0 | 0 | 1 | 0 | 0 | 0 | 0 | 0 | 0 | 0 | 0 | 0 | 0 | 0 | 0 | 0 | 0 |

Table 2-continued

| Writable/Readable Rhythm Storing Memory (Instrument B) | | | | | | | | | | | | | | | | | | | | | | | |
|---|---|---|---|---|---|---|---|---|---|---|---|---|---|---|---|---|---|---|---|---|---|---|---|
| 2 Slow Rock | 1 | 0 | 0 | 0 | 0 | 0 | 0 | 0 | 0 | 0 | 1 | 0 | 1 | 0 | 0 | 0 | 0 | 0 | 0 | 0 | 0 | 1 | 0 |
| . | | | | | | | | | | | | | | | | | | | | | | | |
| . | | | | | | | | | | | | | | | | | | | | | | | |
| . | | | | | | | | | | | | | | | | | | | | | | | |
| n | | | | | | | | | | | | | | | | | | | | | | | |

Table 3

| Writable/Readable Rhythm Storing Memory (Instrument C) | | | | | | | | | | | | | | | | | | | | | | | |
|---|---|---|---|---|---|---|---|---|---|---|---|---|---|---|---|---|---|---|---|---|---|---|---|
| Address / Bit | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 |
| 1 Samba | 0 | 0 | 0 | 0 | 0 | 0 | 0 | 0 | 0 | 0 | 0 | 0 | 1 | 0 | 0 | 1 | 0 | 0 | 0 | 0 | 0 | 0 | 0 | 0 |
| 2 Slow Rock | 0 | 0 | 0 | 0 | 0 | 0 | 1 | 0 | 0 | 0 | 0 | 0 | 0 | 0 | 0 | 0 | 0 | 0 | 1 | 0 | 0 | 0 | 0 | 0 |
| . | | | | | | | | | | | | | | | | | | | | | | | | |
| . | | | | | | | | | | | | | | | | | | | | | | | | |
| . | | | | | | | | | | | | | | | | | | | | | | | | |
| n | | | | | | | | | | | | | | | | | | | | | | | | |
| Address / Bit | 24 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 |
| 1 Samba | 0 | 0 | 0 | 0 | 0 | 0 | 0 | 0 | 0 | 0 | 0 | 0 | 1 | 0 | 0 | 1 | 0 | 0 | 1 | 0 | 0 | 0 | 0 | 0 |
| 2 Slow Rock | 0 | 0 | 0 | 0 | 0 | 0 | 1 | 0 | 0 | 0 | 0 | 0 | 0 | 0 | 0 | 0 | 0 | 0 | 1 | 0 | 0 | 0 | 0 | 0 |
| . | | | | | | | | | | | | | | | | | | | | | | | | |
| . | | | | | | | | | | | | | | | | | | | | | | | | |
| . | | | | | | | | | | | | | | | | | | | | | | | | |
| n | | | | | | | | | | | | | | | | | | | | | | | | |

What is claimed is:

1. An apparatus for writing information concerning a rhythm pattern unit in a storage for generation of a rhythm by way of a repetition of said rhythm pattern unit by an electronic musical instrument, comprising: first reference rhythm information storage means having a storing region including a plurality of addresses for storing in advance, in an address sequence, reference rhythm information concerning a given kind of rhythm pattern unit comprising a combination of first and second information elements, said first information element and said second information element representing respective notes in binary format, second writable/readable rhythm information storage means including a storing region having addresses corresponding to the addresses of said first reference rhythm information storage means for writing/reading, in an address sequence, desired rhythm information concerning a desired rhythm pattern unit comprising a combination of said first and second information elements, reference clock signal generating means comprising first means for generating a first reference clock signal and second means for generating a second reference clock signal, said second reference clock signal having the same frequency as that of said first reference clock signal, said second reference clock signal further having a delayed phase relative to said first reference clock signal, reference rhythm information read commanding means for commanding reading of said reference rhythm information from said first reference rhythm information storage means, addressing means operatively coupled to said first reference rhythm information storage means and said second writable/readable rhythm information storage means and responsive to said clock signal generating means for addressing said first reference rhythm information storage means and said second writable/-readable rhythm information storage means, rhythm signal generating means operatively coupled to said first reference rhythm information storage means and said second writable/readable rhythm information storage means for generating a rhythm signal representing said rhythm pattern unit stored in said first and second storage means, write commanding means for commanding writing of a desired rhythm information concerning a desired rhythm pattern unit comprising a combination of said first and second information elements, means responsive to said reference rhythm information read commanding means for generating an indication of said reference rhythm information, said write commanding means being operated by an operator with reference to said indication of said reference rhythm information, whereby said desired rhythm information is stored in said second writable/readable rhythm information storage means in a desired corresponding relation with said reference rhythm information in terms of the addresses of said first reference rhythm information storage means and said second writable/readable rhythm information storage means, and write/read control means responsive to said write commanding means for writing said desired rhythm information concerning a desired rhythm pattern unit by way of a combination of said first and second information elements in the addresses of said second writable/readable rhythm information storage means addressed by said addressing means and for reading said desired rhythm information from the addresses of said second writable/readable rhythm information storage means addressed by said addressing means, said write/read control means comprising write control means operatively responsive to said first reference clock signal and to said write commanding means for writing desired rhythm information during said first reference clock signals, and read control means operatively responsive to said second reference clock signal for reading said desired rhythm information from said second writable/readable rhythm information storage means.

2. An apparatus for writing information concerning a rhythm pattern unit in a storage in accordance with claim 1, wherein said reference rhythm information and said desired rhythm information each concern a plurality of kinds of rhythm patterns, said reference rhythm information storage means and said writable/readable rhythm information storage means each comprise at each address a plurality of bit positions allotted to said plurality of kinds of rhythm patterns, and which further comprises rhythm kind selecting means for selecting one of said plurality of kinds of rhythm patterns, and means responsive to said rhythm kind selecting means for selectively withdrawing the output of the bit position corresponding to said selected kind of rhythm pattern of the address.

3. An apparatus for writing information concerning a rhythm pattern unit in a storage in accordance with claim 1, wherein a plurality of said writable/readable rhythm information storage means are provided allotted to a plurality of kinds of musical instruments, said rhythm signal generating means comprises a plurality of rhythm signal generating means coupled to said plurality of writable/readable rhythm information storage means, and which further comprises musical instrument kind selecting means for selecting said plurality of writable/readable rhythm information storage means.

4. A method for writing information concerning a rhythm pattern unit in a storage for generation of a rhythm by way of a repetition of said rhythm pattern unit by an electronic musical instrument, comprising the steps of storing in advance, in an address sequence, in reference rhythm information storing means having a storing region having a plurality of addresses, reference rhythm information concerning a given kind of rhythm pattern unit comprising a combination of first and second information elements, said first information element representing a note being generated and said second information element representing a note being not generated, generating first and second reference clock signals, said second reference clock signals having the same frequency as that of said first reference clock signals, said second reference clock signals further having a delayed phase with respect to said first reference clock signals, commanding reading of said reference rhythm information from said reference rhythm information storage means, addressing, as a function of said clock signals, said reference rhythm information storage means and writable/readable rhythm information storage means, said writable/readable rhythm information storage means having a storing region having addresses corresponding to the addresses of said reference rhythm information storage means, generating, in response to said second reference clock signals and responsive to said step of commanding reading of said reference rhythm information, an indication of said reference rhythm information responsive to said reference rhythm information storage means, commanding writing of desired rhythm information concerning a desired rhythm pattern unit comprising a combination of said first and second information elements, said write commanding step being effected by an operator with reference to said indication of said reference rhythm information, and write controlling, in response to said first reference clock signals, said desired rhythm information concerning a desired rhythm pattern unit by way of a combination of said first and second information elements in the addresses of said writable/readable rhythm information storage means addressed by said addressing step, whereby said desired rhythm information is stored in said writable/readable rhythm information storage means in a desired corresponding relation with said reference rhythm information in terms of the addresses of said reference rhythm information storage means and said writable/readable rhythm information storage means.

5. A method for writing information concerning a rhythm pattern unit in a storage in accordance with claim 4, wherein said reference rhythm information and said desired rhythm information each concern a plurality of kinds of rhythm patterns, said reference rhythm information storage means and said writable/readable rhythm information storage means each comprise at each address a plurality of bit positions allotted to said plurality of kinds of rhythm patterns, and which further comprises the steps of selecting one of said plurality of kinds of rhythm patterns, and selectively withdrawing, as a function of said rhythm kind selecting step, the output of the bit position corresponding to said selected kind of rhythm pattern of the address.

6. A method for writing information concerning a rhythm pattern unit in a storage in accordance with claim 4, wherein a plurality of said writable/readable rhythm information storage means are provided allotted to a plurality of kinds of musical instruments, said rhythm signal generating step comprises the steps of generating rhythm signals each responsive to each of said plurality of writable/readable rhythm information storage means, and which further comprises the step of selecting said plurality of writable/readable rhythm information storage means.

* * * * *